US005948181A

United States Patent [19]

Kohno et al.

[11] Patent Number: 5,948,181

[45] Date of Patent: Sep. 7, 1999

[54] HOT-ROLLED STAINLESS STEEL STRIP AND METHOD FOR PRODUCING THE SAME

[75] Inventors: Masaaki Kohno; Kazuhide Ishii; Kunio Fukuda; Takumi Ujiro; Susumu Satoh, all of Chiba, Japan

[73] Assignee: Kawasaki Steel Corporation, Kobe, Japan

[21] Appl. No.: 08/939,945

[22] Filed: Sep. 29, 1997

[30] Foreign Application Priority Data

Sep. 30, 1996 [JP] Japan ..... 8-259318
Sep. 8, 1997 [JP] Japan ..... 9-242267

[51] Int. Cl.[6] ..... C22C 38/18; C21D 7/13

[52] U.S. Cl. ..... 148/325; 148/608

[58] Field of Search ..... 148/608, 325, 148/327

[56] References Cited

U.S. PATENT DOCUMENTS 5,427,634 6/1995 Fujita et al. ..... 148/325

FOREIGN PATENT DOCUMENTS 0 789 090 8/1997 European Pat. Off. .
126620 10/1979 Japan ..... 148/325
117867 7/1983 Japan ..... 148/325
3-56639 3/1991 Japan .
6-71330 3/1994 Japan .
7-132317 5/1995 Japan .
7-268456 10/1995 Japan .
7-310145 11/1995 Japan .
8-108210 4/1996 Japan .

*Primary Examiner*—Deborah Yee
*Attorney, Agent, or Firm*—Young & Thompson

[57] ABSTRACT

A hot-rolled stainless steel strip contains at least 10 wt % Cr and 1.0 wt % or less of Si, and has a controlled scale thickness of not more than 2.5 μm in the surface layer. The average thickness of the Si-containing oxide layer formed in the scale/alloy substitute interface is 0.1 μm or less. The hot-rolled stainless steel strip is produced by hot rolling at an elongation rate of at least 150 or hot rough rolling to form a sheet bar, descaling by spraying superhigh pressure water to the surface of the sheet bar at an impact pressure (p) of 25 kgf/cm$^2$ or more and a flow rate density of 0.002 l/cm$^2$ or more, and then finish rolling so that the maximum reduction ratio per pass satisfies certain disclosed criteria.

6 Claims, 4 Drawing Sheets

HOT-ROLLED STAINLESS STEEL STRIP AND METHOD FOR PRODUCING THE SAME

BACKGROUND OF THE INVENTION

1. Field of the Invention

The present invention relates to a hot-rolled stainless steel strip (a generic term including steel sheet), and a method for producing the same. More particularly, the present invention relates to a hot-rolled stainless steel strip which can be worked by bending, drawing, etc., without first descaling the strip by pickling after hot-rolling, and which has excellent descalability if pickling is to be performed, as well as excellent surface properties after descaling, and a production method for such steel strip.

2. Description of the Related Art

A hot-rolled stainless steel strip is generally produced by hot-rolling a steel slab formed by continuous casting after heating at about 1100 to 1300° C. The hot-rolled stainless steel strip is then subjected to continuous or batch annealing or passed through sulfuric acid bath and mixed nitric acid/hydrofluoric acid bath for pickling without annealing, and then cold-rolled to form a cold-rolled stainless steel strip. The cold-rolled stainless steel strip is further annealed and pickled, and then used for various applications.

On the other hand, in some cases, the hot-rolled stainless steel strip is annealed, pickled and then used for various applications without cold-rolling.

Since stainless steel contains much Cr, a Fe—Cr oxide layer mainly comprising $(Fe,Cr)_2O_3$ and $(Fe,Cr)_3O_4$ is formed on the surface of the steel strip during hot rolling, and an intermediate oxide layer comprising $SiO_2$ is formed at the interface of the Fe—Cr oxide layer and the alloy substitute, due to Si present in the steel. Cold rolling after annealing of the hot-rolled steel strip having such oxide layers (scales) causes peeling of the scales during rolling, thereby damaging the cold rolling roll and causing bite defects in the surface of the strip. In order to remove such harmful scales, a pickling step is performed after the hot rolling step in a production line for stainless steel. However, since the scales of the hot-rolled stainless steel strip are dense and have poor descalability by pickling, the pickling rate must be decreased, thereby decreasing productivity.

In order to increase the pickling rate by improving the descalability, shot blasting, in which the scales are cracked by spraying hard fine particles (shot particles) on the surface of the steel strip under high pressure, is frequently performed before pickling. However, unevenness (referred to as "shot blast marks") results on the surface of the shot-blast strip, and thus the surface roughness is increased, thereby deteriorating surface quality. It is therefore difficult to use a pickled hot-rolled stainless steel strip as a substitute for a cold-rolled steel strip.

In order to solve these problems, it has been proposed to mechanically apply several percent bending stress to the strip, or to use a polishing brush to decrease the residual shot blast marks (shot blast marks remaining after pickling). However, such methods cannot completely remove the shot blast marks. In addition, such shot blast marks remain after cold-rolling, and cause an undesired reduction in the surface glossiness of the cold-rolled steel strip.

On the other hand, in order to improve the descalability, a procedure for thinning the scales is desirable, and a method of suppressing scaling in the hot rolling step has been proposed. For example, Japanese Patent Unexamined Publication Nos. 58-53323, 59-97710 and 61-123403 disclose a method comprising providing a box whose interior has a controlled atmosphere of inert gas or reducing gas in the region between the outlet side of a final rolling mill and a coiler, with the hot-rolled steel strip being passed through the box after rolling.

In this method, only the scales produced after the final pass remain after coiling, and the scales produced before the final pass are removed in each pass of hot rolling. Therefore, this is based on the technique of controlling the scale thickness by maintaining the strip passage region between the outlet side of the final rolling mill and the coiler in a non-oxidizing atmosphere in order to prevent scaling in this region. However, this method requires gas sealing over the entire wide region between the final rolling mill and the coiler. This technique therefore is quite costly, as it requires installation of a gas sealing apparatus, and supply of a large amount of gas.

Another known method involves removing the scales produced between heating of a slab and hot rough rolling, especially the red scales harmful to pickling, so as to decrease the amount of the scales remaining after pickling. For example, Japanese Patent Unexamined Publication No. 6-71330 discloses a method of descaling an austenitic stainless steel sheet by spraying high-pressure water on the surface of the steel sheet at an impact pressure of 20 to 180 $g/mm^2$ and a flow rate of 0.1 to 0.6 $l/(min.mm^2)$ before hot finish rolling. Although this method can decrease the amount of scale defects caused mainly by Si oxides, it cannot completely eliminate the scale defects. Also, this method does not permit increasing the pickling rate or achieving pickling without shot blasting. When the method disclosed in Japanese Patent Unexamined Publication No. 6-71330 is applied to a ferritic stainless steel sheet, baking occurs due to metal contact between the roll surfaces of the finish rolling rolls and the surface of the steel sheet, thereby causing the problem of surface defects.

Furthermore, Japanese Patent Unexamined Publication No. 8-108210 discloses a method of producing a hot-rolled ferritic stainless steel strip comprising descaling by spraying high-pressure water on the surface of the steel strip with impact energy ($kJ/m^2$)of [−6.00×10−6T+8.60 ×10] or more, wherein T indicates the temperature (° C.) of the steel strip immediately before descaling, between the end of hot finish rolling and coiling.

However, this method requires a high flow rate of water for obtaining high impact energy, and has the drawback of significantly increasing the size of the associated equipment. Also, since high-pressure water is sprayed after the steel strip is thinned, the surface of the steel strip is locally deformed, and thus the shape of the steel strip becomes unstable, thereby causing difficulty during rolling in some cases.

On the other hand, if a hot-rolled stainless steel strip having scales can be used for applications in which little attention is given to the surface properties, then the pickling step can be omitted, and thus significant cost reduction is expected. However, if the hot-rolled stainless steel strip having scales produced by a conventional process is subjected to molding using a mold, such as bending, drawing, or the like, the scales are partially peeled off, thereby causing the problem of deteriorating the life of the mold and polluting the working environment due to the scattered dust.

SUMMARY OF THE INVENTION

An object of the present invention is to solve the above problems of conventional materials and techniques by providing a hot-rolled stainless steel strip having scale adherence which causes neither peeling nor dust even if the steel strip having scales is worked, a grade of descalability which requires no shot blasting before pickling, and excellent surface quality without baking defects; as well as a method for producing such steel strip.

In order to achieve the object, the inventors repeatedly performed intensive experiments and research as to the influence of the scale structure of a hot-rolled stainless steel strip having scales on the scale adherence and descalability in working of the hot-rolled stainless steel strip, and the relation between the scale structure and hot rolling conditions. As a result, it was discovered that a hot-rolled stainless steel strip having a specified composition and specified scale structure possesses the above desirable properties, and such a hot-rolled stainless steel strip can be obtained under specified hot rolling conditions. The present invention has been achieved on the basis of these findings.

Namely, it was discovered that in molding such as bending, drawing, or the like, the scale adherence of a hot-rolled stainless steel strip containing 10 wt % or more of Cr and 1.0 wt % or less of Si can be significantly improved by reducing the thickness of the scales to a value of 2.5 $\mu$m or less, which has not heretofore been achieved. Also, it was discovered that in processes without shot blasting, the thickness of hot rolling scales and the thickness of the Si-containing oxide layer formed in the scale/alloy substitute interface are important for descalability in the pickling step using sulfuric acid-nitric acid/hydrofluoric acid subsequent to a hot rolling step, and shot blasting can be omitted by decreasing the scale thickness to 2.5 $\mu$m or less and the thickness of the Si oxide layer to 0.1 $\mu$m or less. As a result of further study of the relation between the scale structure and hot-rolling conditions, it was found that when producing a hot-rolled stainless steel strip by hot-rolling a slab containing 10 wt % or more of Cr and 1.0 wt % or less of Si, the steel strip can be produced by hot rolling in such a manner that the elongation rate is 150 or more, wherein:

$$\text{Elongation rate}=(\text{Area of rolling surface of steel strip after hot finish rolling})/(\text{Area of rolling surface of slab}) \quad (1)$$

The inventors further studied phenomena associated with the hot rolling conditions, particularly conditions of descaling before hot finish rolling and conditions of subsequent hot finish rolling. As a result, when superhigh pressure descaling was practiced, which has not heretofore been performed, and subsequent hot finish rolling was appropriately carried out, the scale thickness on the surface of the hot-rolled steel strip could be decreased to 2.5 $\mu$m or less, and the thickness of the Si oxide layer could be decreased to 0.1 $\mu$m or less.

It was also found that this method does not produce baking defects which occur in conventional hot finish rolling after descaling using such superhigh pressure water, and can produce hot-rolled stainless steel having excellent surface quality.

BRIEF DESCRIPTION OF THE DRAWINGS

The above and other features and advantages of the invention will become more apparent from the following description of several preferred embodiments, taken with reference to the accompanying drawings, in which.

DESCRIPTION OF PREFERRED EMBODIMENTS

Figure 1:
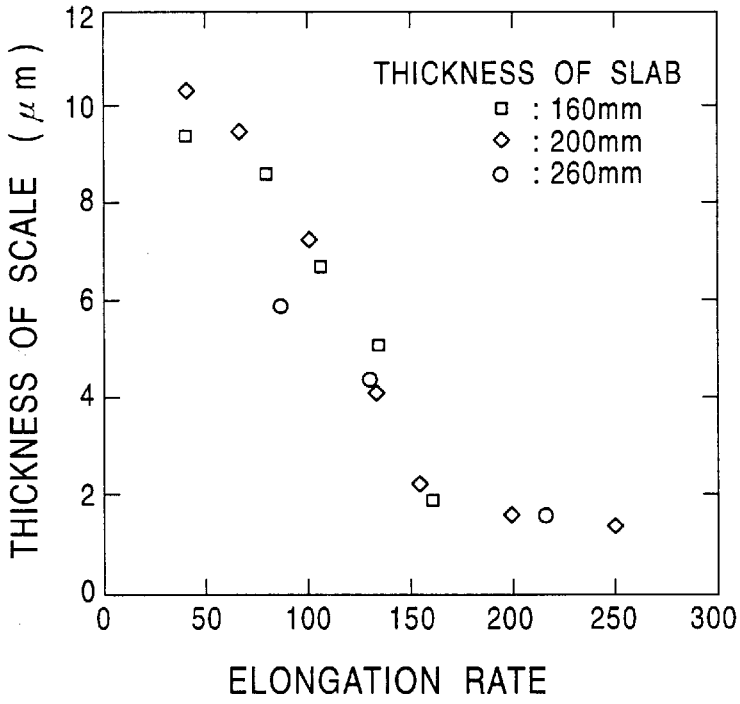
FIG. 1 is a graph showing the relation between the elongation rate and the scale thickness.
Figure 2:
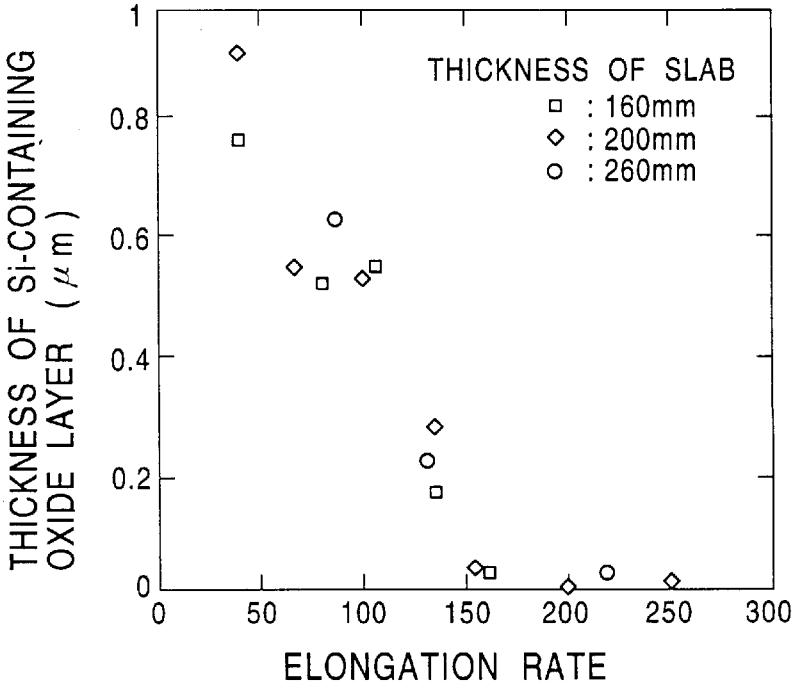
FIG. 2 is a graph showing the relation between the elongation rate and the thickness of a Si-containing oxide layer.
Figure 3:
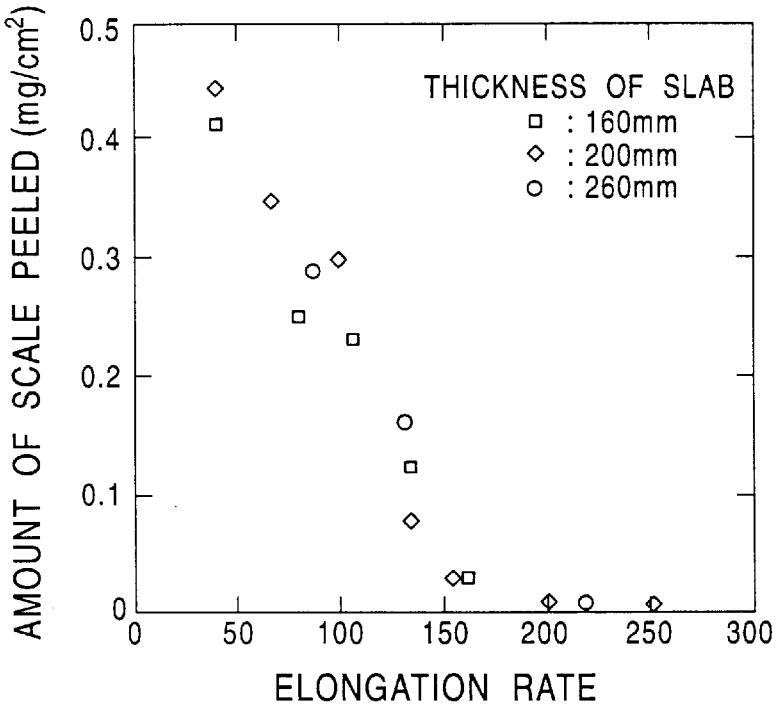
FIG. 3 is a graph showing the relation between the elongation rate and the amount of scales peeled after working.
Figure 4:
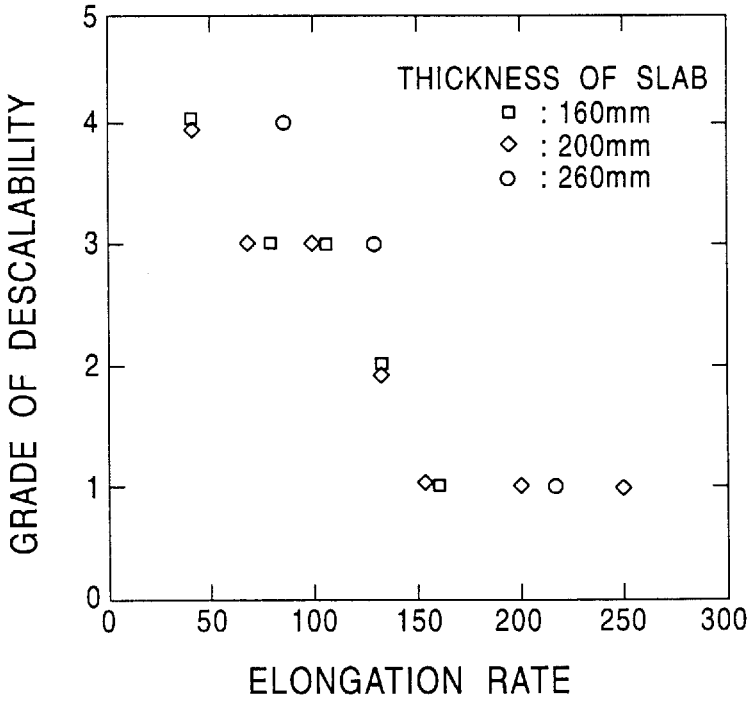
FIG. 4 is a graph showing the relation between the elongation rate and descalability.

A hot-rolled stainless steel strip of the present invention contains at least 10 wt % Cr and not more than 1.0 wt % Si, the oxide scale layer formed on the surface thereof has an average thickness of 2.5 $\mu$m or less, and the Si-containing oxide layer formed at the scale/alloy substitute interface has a thickness of 0.1 $\mu$m or less.

A brief explanation of these content guidelines is as follows:

Cr: at Least 10 wt %

In order to improve scale adherence during molding, it is important that the scale thickness of the surface layer of the steel strip be not more than about 2.5 $\mu$m. In this case, if the Cr content of the stainless steel is less than 10 wt %, it is difficult to obtain a scale structure having a thickness of 2.5 $\mu$m or less, and the corrosion resistance initially possessed by stainless steel is insufficient. Therefore, the Cr content is preferably 10 wt % or more. The upper limit of the Cr content is preferably about 30 wt % for reasons of economy.

Si: 1.0 wt % or Less

If the Si content of the alloy base exceeds about 1.0 wt %, the thickness of the Si-containing oxide layer will exceed 0.1 $\mu$m even after hot rolling at an elongation rate of 150 or more. Therefore, the Si content of steel is preferably 1.0 wt % or less. The lower limit of the Si content is preferably about 0.1 wt % because Si is an element effective for deoxidizing steel and improving the oxidation resistance at high temperatures.

Although other elements are not particularly limited, conventional ranges may be used as the content ranges of the other elements.

Average Thickness of the Oxide Scale Layer on the Surface of the Steel Strip: 2.5 $\mu$m or Less It was found that when the average thickness of scales of the surface layer on the hot-rolled stainless steel strip is maintained at 2.5 μm or less, the scale adherence (resistance to peeling) in molding is significantly improved, and descalability is also improved. Although the exact reasons for the relation between descalability and the scale thickness are not presently known, the scale thickness possibly affects the permeation force of an acid which reaches the alloy substitute through fine cracks produced in the scales due to rebending after hot rolling and bending strain of the strip introduced in the annealing process.

Average Thickness of the Si-Containing Oxide Layer: 0.1 μm or Less

It was found that in processes not using shot blasting, the descalability greatly depends upon the total thickness of the scales and the thickness of the Si-containing oxide layer (considered as a $SiO_2$ layer) formed at the scale/alloy substitute interface. If the average thickness of the Si-containing oxide layer (considered as a $SiO_2$ layer) exceeds 0.1 μm, the descalability significantly deteriorates, and thus mechanical descaling such as shot blasting or the like is required before pickling. With an average thickness of 0.1 μm or less, the descalability is improved to an extent which eliminates the need for mechanical descaling. Namely, in order to obtain a hot-rolled stainless steel sheet having excellent surface quality after pickling without the need for mechanical descaling before pickling, for example, a hot-rolled stainless steel sheet without shot blast marks, it is necessary that the average thickness of all scales is 2.5 μm or less, and the average thickness of the Si-containing oxide layer is 0.1 μm or less.

The method of The method of measuring the thickness of the scales and the thickness of the Si-containing oxide layer will be described in detail later.

The production method of the present invention will now be described.

A first method comprises hot-rolling a slab containing 10 wt % or more of Cr and 1.0 wt % or less of Si at an elongation rate of 150 or more, as represented by the following equation (1):

$$\text{Elongation rate}=(\text{Area of rolling surface of steel strip after hot finish rolling})/(\text{Area of rolling surface of slab}) \quad (1)$$

so that the average thickness of the oxide scale layer formed on the surface of the steel strip can be decreased to 2.5 μm or less, and the average thickness of the Si-containing oxide layer formed at the scale/alloy substitute interface can be decreased to 0.1 μm or less. The exact reasons why the thicknesses can be controlled as described above by hot-rolling at an elongation rate of 150 or higher are not presently known. However, in regard to the point that the thickness of the scale surface layer is decreased to 2.5 μm or less, it is thought that surface scales are elongated under the hot-rolling condition of a high elongation rate, and the scale thickness decreases as rolling proceeds. It is also thought that in hot rolling at an elongation rate of as high as 150 or higher, which has not previously been used, scales are partially cracked in the later stage of hot rolling, scales are newly produced in the surface of the alloy substitute newly exposed in the cracked portion, and the new scales finally become thinner than the scales produced before cracking.

As a result of experiments performed by the inventors with respect to the point that the thickness of the Si-containing oxide layer is controlled to 0.1 μm or less, it was discovered that the Si-containing oxide layer is produced and grown during heating of the slab at a temperature of 1100° C. or more, which is the temperature of the initial stage (rough rolling) of hot rolling, but is scarcely further produced in the temperature region (about 600 to 1010° C.) of the later stage (finish rolling) of hot rolling. Therefore, the possible reasons why such a thin Si-containing oxide layer is present after coiling is that the initial Si-containing oxide layer is thinned by elongation as described above, and also a new Si-containing oxide layer is scarcely produced in the exposed surface of the alloy substitute in the cracks produced in the later stage of hot rolling. The upper limit of the elongation rate is not particularly limited within the allowable range of the rolling ability of hot-rolling equipment.

A second method comprises hot rough rolling of a stainless steel slab having a composition containing 10 wt % or more of Cr and 1.0 wt % or less of Si to form a sheet bar, spraying superhigh pressure water on the surface of the sheet bar at impact pressure (p) per unit spray area of 25 kgf/cm$^2$ or more, which is represented by equation (2) below, and a flow rate density of 0.002 l/m$^2$ or more, and then performing finish rolling in such a matter that the maximum reduction ratio R per pass satisfies equation (3) below, to control the average thickness of the oxide scale layer formed on the surface of the steel strip to 2.5 μm or less, and the average thickness of the Si-containing oxide layer formed at the interface of the scale layer and the alloy substitute to 0.1 μm or less.

$$p=5.64PQ/H^2 \quad (2)$$

p: impact pressure (kgf/cm$^2$)

P: water pressure of nozzle (kgf/cm$^2$)

Q: water comsumption

H: distance between the surface of the steel strip and nozzle (cm)

$$R\leqq -0.9Cr+54 \quad (3)$$

R: maximum reduction ratio per pass (%)

Generally known conditions may be employed for heating the slab and for hot rough rolling. For example, slab heating is preferably done in a temperature range of 1050 to 1300° C.

For descaling before hot finish rolling, superhigh pressure water is sprayed on the surface of the sheet bar. Descaling is performed by using superhigh pressure water spray at an impact pressure of 25 kgf/cm$^2$ or more per unit spray area and a flow rate density of 0.002 l/cm$^2$ or more. The flow rate density used in the present invention represents the total amount of water supplied per unit area of the sheet bar in descaling. When the impact pressure of superhigh pressure water is less than 25 kgf/cm$^2$, and the flow rate density is less than 0.002 l/cm$^2$, the thickness of the scales on the surface of the hot-rolled steel strip exceeds 2.5 μm after finish rolling. When the scale thickness of the hot-rolled steel strip exceeds 2.5 μm, pickling without shot blasting locally leaves thick scales, and it is thus impossible to achieve complete descaling. Although the mechanism of the effects of descaling by superhigh pressure water spray on the scale thickness of the hot-rolled steel strip, ease of descaling, and surface quality are not yet apparent, one theory is as follows:

Under high impact pressure of 25 kgf/cm$^2$ or more, descaling is effected to the same extent as that attained by descaling by general high pressure water at an impact pressure of 1 to 4 kgf/cm$^2$, and unevenness of the surface layer of the alloy substitute is smoothed to suppress the local remainder of scales in recesses. Also, descaling under such high impact pressure possibly prevents scales from cutting into the steel strip due to falling of projections into recesses during hot finish rolling. At a flow rate density of 0.002 l/cm$^2$ or more, only the surface layer is effectively cooled immediately after descaling, and thus scaling is possibly suppressed.

The descaled sheet bar is then subjected to hot finish rolling to form a hot-rolled steel strip. In the second method, hot finish rolling is appropriately controlled so as to prevent the occurrence of baking and seizing between the finish rolling roll and the surface of the steel strip.

In order to prevent the occurrence of baking and seizing, finish rolling is controlled according to the Cr content of the material so that the maximum reduction ratio R per pass during hot finish rolling satisfies the equation (3). When the maximum reduction ratio R per pass does not satisfy equation (3), baking occurs. This is possibly because a very thin scale layer formed on the surface of the steel strip after descaling is not sufficiently elongated during rolling due to an excessively high reduction ratio, and thus the thin scale layer is broken to expose a new surface and cause metal contact between the rolls and the surface of the steel strip. The Cr content of the material is possibly related to the amount of the scaled produced, and the adhesion between the roll surface and the new exposed surface of the steel strip in the roll bite.

The conditions for hot finish rolling other than the reduction ratio per pass, for example, the rolling temperature, the coiling temperature, etc., can be selected according to desired material properties. Although not limited, a decrease in the finish rolling temperature increases the rolling load, and adversely affects passage properties and the rolling mill. Therefore, for example, the finish rolling temperature for steel having an austenite texture is preferably 950° C. or more, and the finish rolling temperature for steel having a ferritic texture is preferably 700° C. or more.

EXAMPLES

Example 1

Slabs having the various thicknesses shown in Table 2-1 and 2—2 were produced by continuous casting of the stainless steel compositions shown in Table 1, hot-rolled at the various elongation rates shown in Table 2-1, 2—2, and then coiled to obtain hot-rolled steel sheets having the various thicknesses shown in Table 2-1, 2—2. The slab heating temperatures were 1150° C. (steel A-1), 1200° C. (steel B-1) and 1100° C. (steels C-1, D-1 and E-1), respectively, and the coiling temperatures for all sheets were 800° C.

A steel sheet was cut off from the top end of coil in the lengthwise direction, the middle of coil and the tail end of coil of each hot-rolled coil. A sample was obtained from a half width (the center of the width) in the transverse direction, a ¼ width and a distance of 30 mm from the edge of the coil. The scales of the samples were measured, and an average scale thickness was determined. To measure the thickness of the scales and the thickness of the Si-containing oxide layer, a polished section of each of the samples which were cut out from the hot-rolled steel sheet was observed by SEM (Scanning type Electron microscope), and the distance between the scale surface and the surface of the alloy substitute was directly measured from the photographic image to obtain a value as the scale thickness. The composition of the scale layer was further analyzed by AES (Auger Electron Spectro.scopy) analysis, and the thickness of a layer from which a Si peak was detected was measured as the thickness of the Si-containing oxide layer. Furthermore, an $SiO_2$ peak was observed in X-ray diffraction of the scale layer. Therefore, the Si-containing oxide layer was considered as an $SiO_2$ layer.

The scale adherence during working was evaluated by the amount of scale peeling. A tensile test piece of 10 mm width×100 mm length was cut from the hot-rolled steel sheet in the rolling direction, and adhesive tape was adhered to the front and back sides of a gage mark portion (10 mm×20 mm) of the test piece. After 10% tensile working, the tapes were peeled off, and an increase in the weight of the tapes after peeling was measured.

The descalability was evaluated by the following method. A test piece (100x100mm)was cut from the hot-rolled steel sheet, pickled with sulfuric acid ($H_2SO_4$ [200 g/l]) and a mixed acid ($HNO_3$ [150 g/l]+HF [25 g/l]) in a laboratory. After pickling, the sheet surface was visually inspected, and evaluation was made on the basis of the following four grades:

1: No residual scale (the area ratio of residual scales was 0%)
2: Residual scale dots (the area ratio of residual scales was 1% or less)
3: Residual scale blocks (the area ratio of residual scales was over 1% and less than 5%)
4: Residual scale stripes (the area ratio of residual scales was 5% or more)

The results are shown in Table 2-1, 2—2.

For example, FIGS. 1, 2, 3 and 4 show the relations of the elongation rate of the hot-rolled steel sheet obtained by hot-rolling a slab of steel A-1 (TYPE 430 [16Cr-0.06C]; Nos. 1—1 to 1-15) to the scale thickness, the thickness of the Si-containing oxide layer, the amount of the scales peeled and the descalability, respectively. The thicknesses of the scales and the Si-containing oxide layer decrease as the elongation rate increases, regardless of the thicknesses of the slab and the hot finished rolled steel sheet. At an elongation rate of 150 or higher, a scale thickness of 2.5 $\mu$m or less can be attained, and at the same time, the thickness of the Si-containing oxide layer can be controlled to 0.1 $\mu$m or less (see FIGS. 1 and 2). Accordingly, in steels Nos. 1-5, 1-10, 1-11, 1-12 and 1-15, the amount of the scales peeled was as low as 0.1 mg/cm$^2$ or less (see FIG. 3), and no residual scale was observed after pickling (see FIG. 4). Thus, the hot-rolled steel sheet has a level of scale adherence which causes no trouble of deterioration in a mold or generation of dust pollution, even if a steel sheet is worked without being descaled, and at the same time, has a scale structure with excellent descalability even if it is not mechanically descaled before pickling.

This tendency is true of austenitic stainless steel slab B (Type 304; Nos. 1-16–1-20) containing a large amount of Ni, and slabs C and D (Nos. 1-21–1-26) having a relatively low Cr content of about 11 wt %.

However, in the hot-rolled steel sheet (No. 1-27) produced by hot-rolling slab E having a Si content of 1.4 wt % at an elongation rate of 200.0, the scale thickness was controlled to 2.0 $\mu$m, and the amount of the scales peeled after working was as small as 0.02 mg/cm$^2$. This hot-rolled steel sheet thus exhibited good scale adherence. However, the thickness of the Si-containing oxide layer in the scale layer was 0.21 $\mu$m and thus exceeds 0.1 $\mu$m, and residual point scales were observed after pickling.

Therefore, it is apparent that the hot-rolled stainless steel sheet rolled at an elongation rate of 150 or higher in accordance with the method of the present invention exhibits a small amount of scales peeled when the stainless steel with scale is worked, regardless of the thickness of the original slab and the thickness of the hot finished rolled sheet. It is also apparent that when hot-rolling a stainless steel material having an Si content limited to 1.0 wt % or less in accordance with the method of the present invention, a hot-rolled stainless steel sheet having excellent descalability can be obtained without using mechanical pretreatment such as shot blasting or the like.

TABLE 1

| Steel | Chemical Component (Wt %) | | | | | | | | | |
|---|---|---|---|---|---|---|---|---|---|---|
| No. | C | Si | Mn | P | S | Al | Cr | Ni | N | Ti |
| A-1 | 0.06 | 0.3 | 0.6 | 0.03 | 0.006 | 0.002 | 16.2 | 0.3 | 0.05 | — |
| B-1 | 0.05 | 0.5 | 1.0 | 0.03 | 0.004 | 0.002 | 18.2 | 8.3 | 0.04 | — |
| C-1 | 0.01 | 0.2 | 0.3 | 0.02 | 0.002 | 0.020 | 11.5 | 0.1 | 0.01 | 0.23 |
| D-1 | 0.01 | 0.9 | 0.4 | 0.02 | 0.003 | 0.010 | 11.3 | 0.1 | 0.02 | 0.25 |
| E-1 | 0.02 | 1.4 | 0.3 | 0.03 | 0.003 | 0.010 | 11.2 | 0.1 | 0.01 | 0.22 |

TABLE 2-1

| No. | A | B | C | D | E | F | G | H | Remark |
|---|---|---|---|---|---|---|---|---|---|
| 1-1 | A-1 | 160 | 4.0 | 40.0 | 9.3 | 0.76 | 4 | 0.41 | Comparative Example |
| 1-2 | A-1 | 160 | 2.0 | 80.0 | 8.6 | 0.52 | 3 | 0.25 | Comparative Example |
| 1-3 | A-1 | 160 | 1.5 | 106.7 | 6.7 | 0.55 | 3 | 0.23 | Comparative Example |
| 1-4 | A-1 | 160 | 1.2 | 133.3 | 5.1 | 0.17 | 2 | 0.12 | Comparative Example |
| 1-5 | A-1 | 160 | 1.0 | 160.0 | 2.0 | 0.03 | 1 | 0.03 | Invention Example |
| 1-6 | A-1 | 200 | 5.0 | 40.0 | 10.3 | 0.91 | 4 | 0.44 | Comparative Example |
| 1-7 | A-1 | 200 | 3.0 | 66.7 | 9.4 | 0.55 | 3 | 0.35 | Comparative Example |
| 1-8 | A-1 | 200 | 2.0 | 100.0 | 7.3 | 0.53 | 3 | 0.3 | Comparative Example |
| 1-9 | A-1 | 200 | 1.5 | 133.3 | 4.2 | 0.28 | 2 | 0.08 | Comparative Example |
| 1-10 | A-1 | 200 | 1.3 | 153.8 | 2.3 | 0.04 | 1 | 0.03 | Invention Example |
| 1-11 | A-1 | 200 | 1.0 | 200.0 | 1.7 | 0.00 | 1 | 0.01 | Invention Example |
| 1-12 | A-1 | 200 | 0.8 | 250.0 | 1.5 | 0.02 | 1 | 0.01 | Invention Example |
| 1-13 | A-1 | 260 | 3.0 | 86.7 | 5.9 | 0.63 | 4 | 0.29 | Comparative Example |

TABLE 2-1-continued

| No. | A | B | C | D | E | F | G | H | Remark |
|---|---|---|---|---|---|---|---|---|---|
| 1-14 | A-1 | 260 | 2.0 | 130.0 | 4.4 | 0.22 | 3 | 0.16 | Comparative Example |
| 1-15 | A-1 | 260 | 1.2 | 216.7 | 1.7 | 0.03 | 1 | 0.01 | Invention Example |

A = Steel
B = Thickness of slab (mm)
C = Thickness of hot-rolled steel sheet (mm)
D = Elongation rate
E = Thickness of scale ($\mu$m)
F = Thickness of Si-containing oxide layer ($\mu$m)
G = Grade of descalability
H = Amount of scale peeled (mg/cm$^2$)

TABLE 2-2

| No. | A | B | C | D | E | F | G | H | Remark |
|---|---|---|---|---|---|---|---|---|---|
| 1-16 | B-1 | 200 | 4.0 | 50.0 | 6.3 | 0.75 | 4 | 0.32 | Comparative Example |
| 1-17 | B-1 | 200 | 2.5 | 80.0 | 5.7 | 0.64 | 4 | 0.28 | Comparative Example |
| 1-18 | B-1 | 200 | 2.0 | 100.0 | 3.9 | 0.31 | 3 | 0.15 | Comparative Example |
| 1-19 | B-1 | 200 | 1.2 | 153.8 | 1.9 | 0.08 | 1 | 0.03 | Invention Example |
| 1-20 | B-1 | 200 | 1.0 | 200.0 | 1.6 | 0.02 | 1 | 0.01 | Invention Example |
| 1-21 | C-1 | 200 | 4.0 | 50.0 | 10.8 | 0.83 | 3 | 0.52 | Comparative Example |
| 1-22 | C-1 | 200 | 2.5 | 80.0 | 9.9 | 0.77 | 2 | 0.43 | Comparative Example |
| 1-23 | C-1 | 200 | 1.6 | 125.0 | 7.1 | 0.61 | 2 | 0.22 | Comparative Example |
| 1-24 | C-1 | 200 | 1.2 | 166.7 | 2.4 | 0.05 | 1 | 0.04 | Invention Example |
| 1-25 | C-1 | 200 | 1.0 | 200.0 | 2.1 | 0.05 | 1 | 0.02 | Invention Example |
| 1-26 | D-1 | 200 | 1.0 | 200.0 | 2.0 | 0.08 | 1 | 0.03 | Invention Example |
| 1-27 | E-1 | 200 | 1.0 | 200.0 | 2.2 | 0.21 | 2 | 0.02 | Comparative Example |

A = Steel
B = Thickness of slab (mm)
C = Thickness of hot-rolled steel sheet (mm)
D = Elongation rate
E = Thickness of scale ($\mu$m)
F = Thickness of Si-containing oxide layer ($\mu$m)
G = Grade of descalability
H = Amount of scale peeled (mg/cm$^2$)

Example 2

Ferritic stainless steel slab A-2 (slab thickness of 200 mm) having the composition shown in Table 3 was heated to 1150° C., and then formed into a sheet bar having a thickness of 30 mm by hot rough rolling (7 passes). The thus-formed sheet bar was then descaled by spraying superhigh pressure water on its surface under the conditions shown in Table 4-1, 4-2, followed by 7 passes of hot finish rolling (the maximum reduction ratio per pass is shown in Table 4-1, 4-2) to obtain a hot-rolled steel sheet having a thickness of 4 mm. The rolling end temperature of hot rough rolling was 970° C., the end temperature of hot finish rolling was 800° C., and the coiling temperature was 700° C. The thus-obtained hot-rolled steel sheet was examined with respect to the thickness of the scales which adhered to the surface, and also with respect to descalability and surface quality after pickling.

The scale thickness of the hot-rolled steel sheet was measured by a method in which the scales were peeled off from the alloy substitute by constant current electrolysis (current density: 20 mA/cm$^2$ or less) using a non-aqueous solvent electrolyte comprising methanol as a solvent, 10% acetylacetone and 1% tetramethylammonium bromide, and weighed, and the measured weight was converted into the scale thickness using a density of 5.2 g/cm$^3$ (the density of $Fe_3O_4$).

For pickling, the steel sheet was annealed in a nitrogen atmosphere at 850° C. for 8 hours, and then pickled by dipping in sulfuric acid ($H_2SO_4$) 200 g/l and a mixed acid ($HNO_3$: 150 g/l, HF: 25 g/l) at a temperature of 80° C. for 100 seconds. After pickling, the surface of the sheet was visually inspected to evaluate the presence of residual scales.

The evaluation of residual scales was made on the basis of the following criteria:

No residual scale was observed: ○

Residual point scales were observed: Δ

No residual scale was observed in a normal potion, but residual scales were observed in the baked portion; □

Residual block scales observed; x

With respect to the surface quality after pickling, the occurrence of roughness due to burning and seizing between the hot rolling roll and the steel sheet surface was examined by visually inspecting the coil surface after actual pickling, and visually inspecting a specimen cut off from the coil and pickled in a laboratory.

Evaluation was made on the basis of the following criteria:

No surface defect such as baking and roughness: ○

Presence of surface defects such as baking and roughness: x

Figure 5:
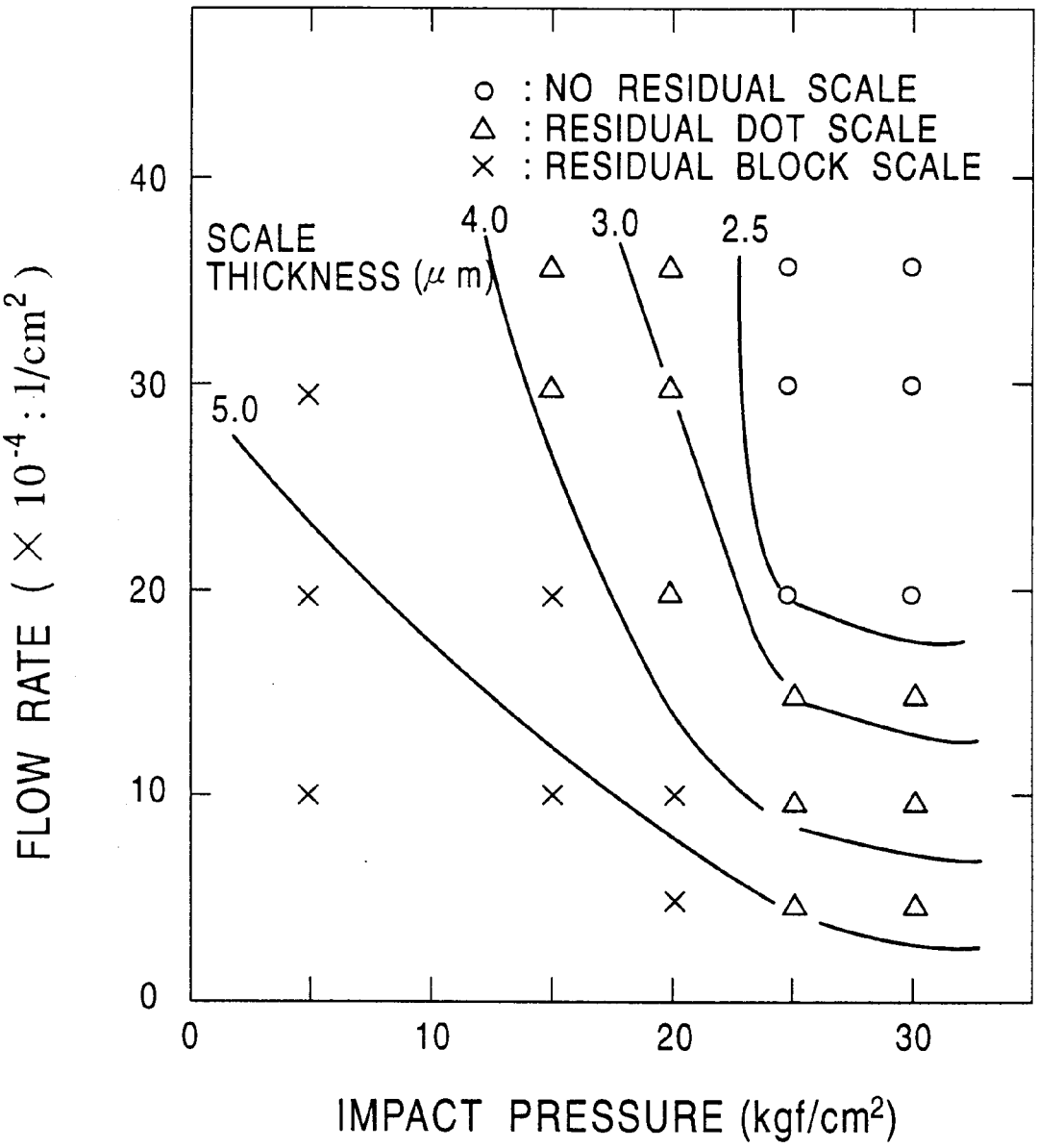
FIG. 5 is a graph showing the relation between the impact pressure of superhigh pressure water and flow rate which affects the scale thickness.

The results are shown in Table 4-1, 4-2. FIG. 5 shows the relation between the descaling conditions and the scale thickness.

Table 4-1, 4-2 and FIG. 5 indicate that under the conditions satisfying the range of the present invention (example Nos. 2-19 to 2-21, 2-23, 2-24, 2-28 to 2-30), the scale thicknesses of all sheets are 2.5 μm or less, and good descalability is obtained without shot blasting. The steel sheets in which the maximum reduction ratio in hot finish rolling satisfies the range of the present invention exhibit good surface quality without defects such as baking during rolling.

TABLE 3

| Steel | Chemical Component (Wt %) | | | | | | | | | |
|---|---|---|---|---|---|---|---|---|---|---|
| No. | C | Si | Mn | P | S | Cr | Ni | Mo | Ti | Nb |
| A-2 | 0.009 | 0.34 | 0.35 | 0.04 | 0.006 | 11.2 | 0.2 | — | 0.22 | — |

TABLE 4-1

| | Steel | Cr content | Descaling condition | | | Finish rolling condition | −0.9 Cr + | Properties of hot-rolled steel strip | | | | |
|---|---|---|---|---|---|---|---|---|---|---|---|---|
| No. | No. | Wt % | I | J | K | L | 54 | M | N | O | P | Remark |
| 2-1 | A-2 | 11.2 | 0 | 0 | 0 | 43.2 | 43.9 | ○ | 9.3 | x | ○ | Comparative Ex. |
| 2-2 | | | 0 | 0 | 0 | 47.1 | | x | 8.2 | x | ○ | Comparative Ex. |
| 2-3 | | | 100 | 5.02 | 10 | 42.9 | | ○ | 6.5 | x | ○ | Comp. Example |
| 2-4 | | | 100 | 5.02 | 10 | 47.3 | | x | 7.1 | x | ○ | Comp. Example |
| 2-5 | | | 100 | 5.02 | 20 | 43.0 | | ○ | 5.2 | x | ○ | Comp. Example |
| 2-6 | | | 100 | 5.02 | 30 | 43.1 | | ○ | 4.7 | x | ○ | Comp. Example |
| 2-7 | | | 300 | 15.06 | 10 | 43.2 | | ○ | 5.9 | x | ○ | Comp. Example |
| 2-8 | | | 300 | 15.06 | 20 | 43.2 | | ○ | 4.6 | x | ○ | Comparative Ex. |
| 2-9 | | | 300 | 15.06 | 30 | 43.1 | | ○ | 4.0 | Δ | ○ | Comparative Ex. |
| 2-10 | | | 300 | 15.06 | 36 | 43.3 | | ○ | 3.8 | Δ | ○ | Comparative Ex. |
| 2-11 | | | 400 | 20.08 | 5 | 42.8 | | ○ | 5.5 | x | ○ | Comparative Ex. |
| 2-12 | | | 400 | 20.08 | 10 | 42.9 | | ○ | 4.8 | x | ○ | Comparative Ex. |
| 2-13 | | | 400 | 20.08 | 20 | 43.0 | | ○ | 3.3 | Δ | ○ | Comparative Ex. |
| 2-14 | | | 400 | 20.08 | 30 | 43.2 | | ○ | 3.1 | Δ | ○ | Comparative Ex. |
| 2-15 | | | 400 | 20.08 | 36 | 43.2 | | ○ | 2.9 | Δ | ○ | Comparative Ex. |

I = Water pressure kgf/cm$^2$

J = Impact pressure kgf/cm$^2$

K = Flow rate × $10^{-4}$ l/cm$^2$

L = Maximum reduction ratio per pass R %

M = Equation (3) $R \leqq -0.9\ Cr + 54$

N = Thickness of scale μm

O = Descalability

P = Baking roughness

TABLE 4-2

| No. | Steel No. | Cr content Wt % | Descaling condition I | J | K | Finish rolling condition L | −0.9 Cr + 54 | M | Properties of hot-rolled steel strip N | O | P | Remark |
|---|---|---|---|---|---|---|---|---|---|---|---|---|
| 2-16 | A-2 | 11.2 | 500 | 25.09 | 5 | 42.8 | 43.9 | ○ | 5.0 | x | ○ | Comparative Ex. |
| 2-17 | | | 500 | 25.09 | 10 | 42.9 | | ○ | 3.9 | Δ | ○ | Comp. Example |
| 2-18 | | | 500 | 25.09 | 15 | 43.1 | | ○ | 3.1 | Δ | ○ | Comp. Example |
| 2-19 | | | 500 | 25.09 | 20 | 43.2 | | ○ | 2.5 | ○ | ○ | Invention Ex. |
| 2-20 | | | 500 | 25.09 | 20 | 43.5 | | ○ | 2.5 | ○ | ○ | Invention Ex. |
| 2-21 | | | 500 | 25.09 | 20 | 38.2 | | ○ | 2.5 | ○ | ○ | Invention Ex. |
| 2-22 | | | 500 | 25.09 | 20 | 47.0 | | x | 2.4 | □ | x | Comparative Ex. |
| 2-23 | | | 500 | 25.09 | 30 | 43.2 | | ○ | 2.2 | ○ | ○ | Invention Ex. |
| 2-24 | | | 500 | 25.09 | 36 | 42.8 | | ○ | 2.2 | ○ | ○ | Invention Ex. |
| 2-25 | | | 600 | 30.11 | 5 | 43.1 | | ○ | 4.6 | Δ | ○ | Comparative Ex. |
| 2-26 | | | 600 | 30.11 | 10 | 43.2 | | ○ | 3.6 | Δ | ○ | Comp. Example |
| 2-27 | | | 600 | 30.11 | 15 | 42.9 | | ○ | 2.9 | Δ | ○ | Comp. Example |
| 2-28 | | | 600 | 30.11 | 20 | 43.2 | | ○ | 2.3 | ○ | ○ | Invention Ex. |
| 2-29 | | | 600 | 30.11 | 30 | 43.3 | | ○ | 1.8 | ○ | ○ | Invention Ex. |
| 2-30 | | | 600 | 30.11 | 36 | 43.3 | | ○ | 1.7 | ○ | ○ | Invention Ex. |

I = Water pressure kgf/cm$^2$
J = Impact pressure kgf/cm$^2$
K = Flow rate × $10^{-4}$ l/cm$^2$
L = Maximum reduction ratio per pass R %
M = Equation (1) R ≦ −0.9 Cr + 54
N = Thickness of scale $\mu$m
O = Descalability
P = Baking roughness

Example 3

Figure 6:
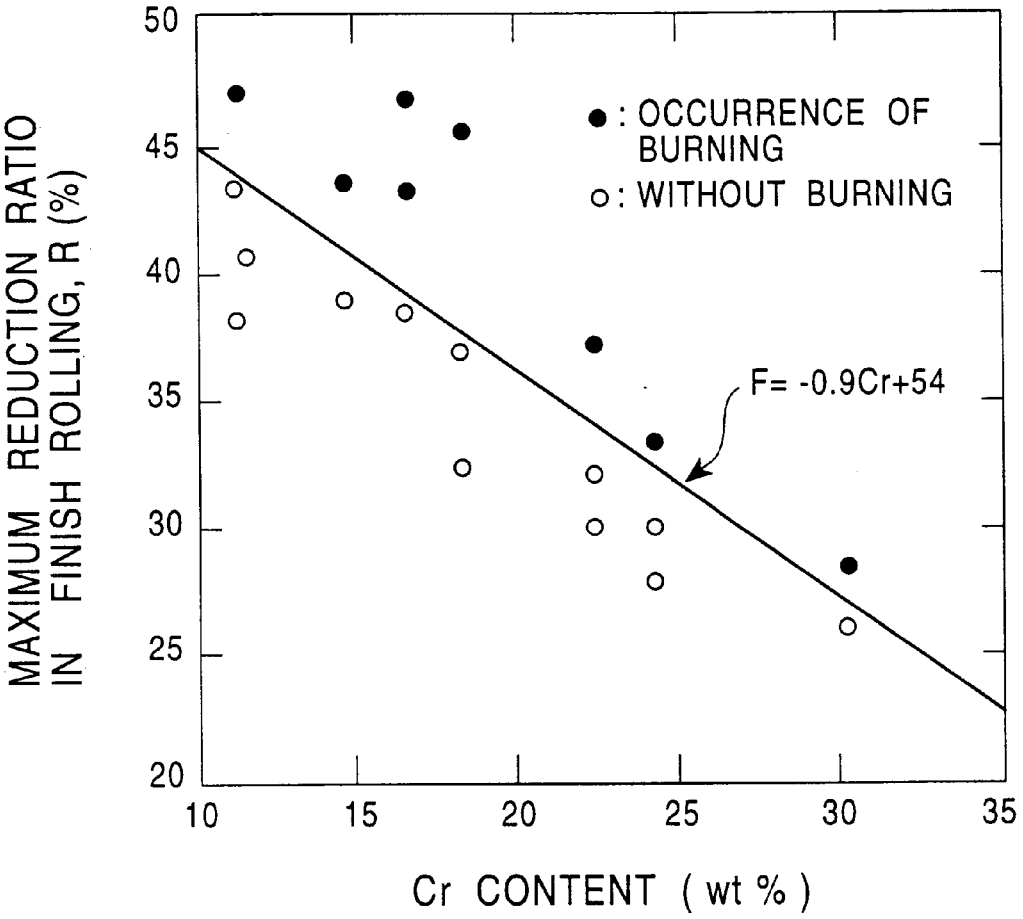
FIG. 6 is a graph showing the relation between the Cr content of a material and the maximum reduction ratio of finish rolling which affects the occurrence of baking defects.

200 mm thick slabs of ferritic stainless steel B-3, C-3, D-3, E-3, F-3, G-3 and H-3 and austenitic stainless steel I-3 in which the Cr content of the composition shown in Table 5 was changed within the range of 10 to 30 wt %, were each formed into a sheet bar by hot rough rolling (7 passes), and descaled by spraying superhigh pressure water under the conditions shown in Table 6-1, 6-2, followed by finish rolling with the maximum reduction ratio per pass shown in Table 6 to obtain a hot-rolled steel sheet having a thickness of 4.0 mm. The thus-obtained hot-rolled steel sheet was examined with respect to the thickness of scales which adhered to the surface, descalability and surface quality after pickling by the same method as Example 2. The results of examination are shown in Table 6-1, 6-2. FIG. 6 shows the relation between the maximum reduction ratio R in hot finish rolling and the Cr content, which affects the occurrence of baking.

Table 6-1, 6-2 and FIG. 6 indicate that under the conditions which satisfy the ranges of the present invention, the scale thickness is 2.5 $\mu$m or less, and good descalability is obtained without shot blasting. The surface quality is also good without defects such as baking. On the other hand, Comparative Examples outside the ranges of the present invention show deterioration in descalability or surface quality due to baking.

TABLE 5

| Steel No. | Chemical Component (Wt %) C | Si | Mn | P | S | Ni | Cr | Mo | Ti | Nb |
|---|---|---|---|---|---|---|---|---|---|---|
| B-3 | 0.005 | 1.50 | 0.65 | 0.04 | 0.003 | 0.2 | 11.5 | — | 0.20 | — |
| C-3 | 0.012 | 0.85 | 0.50 | 0.03 | 0.002 | 0.3 | 14.6 | 0.03 | — | 0.50 |
| D-3 | 0.064 | 0.22 | 0.45 | 0.03 | 0.008 | 0.1 | 16.5 | — | — | — |
| E-3 | 0.005 | 0.06 | 0.30 | 0.04 | 0.002 | 0.1 | 18.2 | 1.10 | 0.30 | — |
| F-3 | 0.018 | 0.55 | 0.20 | 0.03 | 0.004 | 0.1 | 22.3 | 0.65 | — | 0.41 |
| G-3 | 0.001 | 0.30 | 0.20 | 0.02 | 0.009 | 0.2 | 24.1 | 1.90 | — | 0.11 |
| H-3 | 0.002 | 0.25 | 0.30 | 0.02 | 0.004 | 0.3 | 30.2 | 1.80 | — | 0.11 |
| I-3 | 0.070 | 0.51 | 1.04 | 0.03 | 0.005 | 8.5 | 18.2 | 0.02 | — | — |

TABLE 6-1

| No. | Steel No. | Cr content Wt % | Descaling condition I | J | K | Finish rolling condition L | −0.9 Cr + 54 | M | Properties of hot-rolled steel strip N | O | P | Remark |
|---|---|---|---|---|---|---|---|---|---|---|---|---|
| 3-1 | B-3 | 11.5 | 500 | 25.09 | 20 | 38.2 | 43.7 | ○ | 2.3 | ○ | ○ | Invention Example |
| 3-2 | | | 500 | 25.09 | 20 | 43.6 | 43.7 | ○ | 2.4 | ○ | ○ | Invention Example |
| 3-3 | | | 500 | 25.09 | 20 | 40.8 | 43.7 | ○ | 2.4 | ○ | ○ | Invention Example |
| 3-4 | | | 500 | 25.09 | 20 | 47.0 | 43.7 | x | 2.3 | □ | x | Comparative Example |
| 3-5 | C-3 | 14.6 | 500 | 25.09 | 20 | 43.5 | 40.9 | x | 2.3 | □ | x | Comparative Example |
| 3-6 | | | 500 | 25.09 | 20 | 39.0 | 40.9 | ○ | 2.3 | ○ | ○ | Invention Example |
| 3-7 | D-3 | 16.5 | 500 | 25.09 | 20 | 46.8 | 39.2 | x | 2.3 | □ | x | Comparative Example |
| 3-8 | | | 500 | 25.09 | 20 | 43.2 | 39.2 | x | 2.2 | □ | x | Comparative Example |
| 3-9 | | | 500 | 25.09 | 20 | 38.5 | 39.2 | ○ | 2.2 | ○ | ○ | Comparative Example |
| 3-10 | E-3 | 18.2 | 100 | 5.02 | 10 | 46.5 | 37.6 | x | 4.9 | x | ○ | Comparative Example |
| 3-11 | | | 500 | 25.09 | 20 | 45.5 | 37.6 | x | 2.1 | □ | x | Comparative Example |
| 3-12 | | | 500 | 25.09 | 20 | 37.0 | 37.6 | ○ | 2.1 | ○ | ○ | Invention Example |
| 3-13 | | | 500 | 25.09 | 20 | 33.2 | 37.6 | ○ | 2.1 | ○ | ○ | Invention Example |

I = Water pressure kgf/cm$^2$
J = Impact pressure kgf/cm$^2$
K = Flow rate × $10^{-4}$ l/cm$^2$
L = Maximum reduction ratio per pass R %
M = Equation (3) R ≦ −0.9 Cr + 54
N = Thickness of scale μm
O = Descalability
P = Baking roughness

TABLE 6-2

| No. | Steel No. | Cr content Wt % | Descaling condition I | J | K | Finish rolling condition L | −0.9 Cr + 54 | M | Properties of hot-rolled steel strip N | O | P | Remark |
|---|---|---|---|---|---|---|---|---|---|---|---|---|
| 3-14 | F-3 | 22.3 | 500 | 25.09 | 20 | 37.3 | 33.9 | x | 1.8 | □ | x | Comparative Example |
| 3-15 | | | 500 | 25.09 | 20 | 32.1 | 33.9 | ○ | 1.8 | ○ | ○ | Invention Example |
| 3-16 | | | 500 | 25.09 | 20 | 30.1 | 33.9 | ○ | 1.8 | ○ | ○ | Invention Example |
| 3-17 | G-3 | 24.1 | 500 | 25.09 | 20 | 33.2 | 32.3 | x | 1.8 | □ | x | Comparative Example |
| 3-18 | | | 500 | 25.09 | 20 | 30.3 | 32.3 | ○ | 1.8 | ○ | ○ | Invention Example |
| 3-19 | | | 500 | 25.09 | 20 | 28.0 | 32.3 | ○ | 1.8 | ○ | ○ | Invention Example |
| 3-20 | H-3 | 30.2 | 500 | 25.09 | 20 | 28.5 | 26.8 | x | 1.7 | □ | x | Comparative Example |
| 3-21 | | | 500 | 25.09 | 20 | 26.0 | 26.8 | ○ | 1.6 | ○ | ○ | Inventive Example |
| 3-22 | I-3 | 18.2 | 300 | 15.06 | 20 | 35.9 | 37.6 | ○ | 5.8 | x | ○ | Comparative Example |
| 3-23 | | | 600 | 30.11 | 20 | 40.7 | 37.6 | x | 2.5 | □ | x | Comparative Example |
| 3-24 | | | 600 | 30.11 | 20 | 35.9 | 37.6 | ○ | 2.4 | ○ | ○ | Invention Example |

I = Water pressure kgf/cm$^2$
J = Impact pressure kfg/cm$^2$
K = Flow rate × $10^{-4}$ l/cm$^2$
L = Maximum reduction ratio per pass R %
M = Equation (3) R ≦ −0.9 Cr + 54
N = Thickness of scale μm
O = Descalability
P = Baking roughness

Example 4

A ferritic stainless steel slab of steel No. D-3 having the composition shown in Table 5 was heated to 1200° C., rough rolled and then descaled by spraying superhigh pressure water under the conditions shown in Table 7. The slab was then formed into a hot-rolled steel sheet having a thickness of 3 mm by hot finish rolling with the maximum reduction ratio in hot finish rolling shown in Table 7. The end temperature of hot finish rolling was 740° C., and the coiling temperature was 510° C. The thus-obtained hot-rolled coil was pickled by dipping in sulfuric acid ($H_2SO_4$) 200 g/l and a mixed acid ($HNO_3$: 150 g/l, HF: 25 g/l) at a temperature of 80° C. for 100 seconds, after shot blasting (Coil Nos, 4-1 and 4-2) or without shot blasting (Coil No. 4-3). The thus-pickled hot-rolled coil was formed into a cold-rolled coil having a sheet thickness of 0.8 mm by tandem rolling with a roll diameter of 250 mm. After annealing, the coil was pickled, and glossiness was measured. The results are shown in Table 7.

TABLE 7

| No. | Steel No. | Cr content Wt % | Descaling condition I | J | K | Finish rolling condition L | −0.9 Cr + 54 | M | Properties of hot-rolled steel strip N | Shot blast | Cold-rolled sheet Glossiness Gs 20° C. | Remark |
|---|---|---|---|---|---|---|---|---|---|---|---|---|
| 4-1 | D-3 | 16.5 | 0 | 0 | 0 | 38.5 | 39.2 | ○ | 6.7 | present | 692 | Comparative Example |
| 4-2 | | | 100 | 5.02 | 10 | 38.3 | | ○ | 4.9 | | 716 | Comparative Example |
| 4-3 | | | 500 | 25.09 | 20 | 38.5 | | ○ | 2.2 | absent | 825 | Invention Example |

I = Water pressure kgf/cm$^2$
J = Impact pressure kgf/cm$^2$
K = Flow rate × $10^{-4}$ l/cm$^2$
L = Maximum reduction ratio per pass R %
M = Equation (1) R ≦ −0.9 Cr + 54
N = Thickness of scale μm Pickling involved treatment by neutral salt electrolysis ($NaSO_4$ (200 g/l) aqueous solution, temperature: 80° C., electrolytic current: 120 C/dm$^2$), and then mixed acid dipping (nitric acid: 100 g/l +hydrofluoric acid: 30 g/l, temperature: 60° C., time: 40 sec). The glossiness was measured by a glossimeter according to JIS Z 8741.

The hot-rolled coil (Coil No. 4-3) produced within the ranges of the present invention has excellent descalability which enables pickling even if shot blasting is omitted, and the cold-rolled coil produced by cold rolling using large-diameter rolls has high surface glossiness, thereby obtaining the cold-rolled steel sheet having good surface quality.

The present invention provides a hot-rolled stainless steel strip which has excellent scale adherence and which can be worked such as by bending and drawing in a state having scales, without causing troubles of deterioration in the mold and dust pollution. The present invention can also produce, at low cost, a hot-rolled steel strip having good descalability and good surface quality without baking defects produced in hot rolling, and thus has significant industrial applicability. The invention also has the benefit that shot blasting, an essential prerequisite to pickling of conventional steel strips, can be omitted.

The hot-rolled steel strip produced by the method of the present invention can be used as a stainless steel strip having good surface quality without unevenness such as shot blast marks for applications in which conventional cold-rolled steel sheets are used. When the hot-rolled steel strip of the present invention is used as a cold rolling material, a cold-rolled product having excellent surface glossiness can be obtained, as compared with conventional hot-rolled steel strips passed through shot blasting.

Although the present invention has been described with reference to several preferred embodiments thereof, those skilled in this art will recognize that those embodiments are by no means given in a limiting sense, but rather serve to illustrate a fuller understanding of the invention. Embodiments other than those specifically described herein, as well as modifications and substitutions of equivalent techniques, will be readily apparent to those skilled in this art from a reading of the present application, and such other embodiments, modifications and substitutions are understood to fall within the true scope and spirit of the following claims.

What is claimed is:

1. A hot-rolled stainless steel strip comprising a composition containing about 10 wt % to about 30 wt % Cr, and Si in an amount of not more than about 1.0 wt %, wherein an oxide scale layer having an average thickness in the range from about 1.5 μm to about 2.5 μm is formed on a surface of said steel strip, and wherein an Si-containing oxide layer is formed at a scale/alloy substitute interface and has a thickness of not more than about 0.1 μm.

2. The hot-rolled stainless steel strip according to claim 1, wherein the Si content is 0.1 to 1.0 wt %.

3. A method of producing a hot-rolled stainless steel strip, comprising:

hot rough rolling a slab having a composition containing about 10 wt % to about 30 wt % Cr and not more than about 1.0 wt % Si to form a sheet bar; and hot finish rolling of the sheet bar, wherein during hot-rolling or during descaling by spraying superhigh pressure water to the surface of the sheet bar and hot finish rolling, the average thickness of the oxide scale layer formed on the surface of the steels strip is controlled in the range from about 1.5 μm to 2.5 μm, and the average thickness of the Si-containing oxide layer formed in the scale/alloy substitute interface is controlled to 0.1 μm or less.

4. The method according to claim 3, wherein hot rolling is performed at an elongation rate of at least about 150, wherein:

elongation rate=(area of rolling surface of steel strip after hot finish rolling)/(area of rolling surface of slab).

5. The method according to claim 3, wherein said controlling step comprises descaling by spraying superhigh pressure water to the surface of the sheet bar at a impact pressure (p) of at least about 25 kgf/cm$^2$ and a flow rate density of 0.002 l/cm$^2$ or more, and wherein said hot finish rolling is performed at a maximum reduction ratio (R) per pass, wherein:

$p=5.64\ PQ/H^2$, in which P is the water pressure of nozzle (kgf/cm$^2$), Q is the water comsumption (l/s), and H is the distance between the surface of the steel strip and the nozzle (cm)

and wherein $R \leqq -0.9Cr + 54$, in which R is the maximum reduction ratio per pass (%).

6. A hot rolled stainless steel strip according to claim 1, which is produced by hot rolling at an elongation rate of at least 150, wherein:

elongation rate=(area of rolling surface of steel strip after hot finish rolling)/(area of rolling surface of slab).

* * * * *